United States Patent [19]

Benani

[11] Patent Number: 4,899,907

[45] Date of Patent: Feb. 13, 1990

[54] DEVICE FOR AUTOMATICALLY DISPENSING TERMINALS FOR ELECTRIC CONDUCTING CABLES

[75] Inventor: André Benani, Seurre, France

[73] Assignee: La Telemecanique Electrique, France

[21] Appl. No.: 144,978

[22] Filed: Jan. 19, 1988

[30] Foreign Application Priority Data

Feb. 19, 1987 [FR] France ..... 87 02426

[51] Int. Cl.[4] ..... G07F 11/16

[52] U.S. Cl. ..... 221/194; 221/297; 221/310; 29/809

[58] Field of Search ..... 221/297, 307, 310, 289, 221/194–196, 294; 29/809, 739; 414/126; 53/235, 236, 244, 245, 249, 250

[56] References Cited

U.S. PATENT DOCUMENTS

| | | | |
|---|---|---|---|
| 1,083,727 | 1/1914 | Claussen | 221/195 X |
| 2,431,121 | 11/1947 | Hunter | 221/307 X |
| 2,861,728 | 11/1958 | La Vine | 221/307 X |
| 3,464,590 | 9/1969 | Giannettino | 221/297 |
| 3,712,506 | 1/1973 | Brownbill | 221/297 X |
| 3,789,575 | 2/1974 | Bross | 53/249 X |
| 4,128,246 | 12/1978 | Hicks et al. | 221/310 X |
| 4,131,982 | 1/1979 | Rose et al. | 29/739 X |
| 4,353,481 | 10/1982 | Tando | 221/307 X |
| 4,389,272 | 6/1983 | Ferri et al. | 29/809 X |
| 4,578,010 | 3/1986 | Harigane et al. | 414/126 |
| 4,710,085 | 12/1987 | Beakes et al. | 414/126 X |

FOREIGN PATENT DOCUMENTS

| | | | |
|---|---|---|---|
| 965058 | 3/1975 | Canada | 221/310 |
| 369066 | 3/1939 | Italy | 221/307 |
| 331089 | 6/1958 | Switzerland | 53/244 |
| 575151 | 4/1976 | Switzerland | 221/310 |
| 822384 | 10/1959 | United Kingdom | 221/297 |
| 1440571 | 6/1976 | United Kingdom | 221/307 |

*Primary Examiner*—Joseph J. Rolla
*Assistant Examiner*—Steven B. Parker
*Attorney, Agent, or Firm*—William A. Drucker

[57] ABSTRACT

A device is provided for automatically dispensing terminals for electric cables into the receptacle of a reception part. The device includes a tubular body containing the terminals, means for causing a relative movement of the body and of the reception part, and resilient grippers mounted on the body and resiliently urged so as to close a lower orifice of the body and thus retain the terminals. An abutment is provided integral with the reception part for causing the grippers to open when the body and the reception part are brought into contact.

7 Claims, 2 Drawing Sheets

E1
E2
E3
E4
E5
E6
E7
F1
F2
F

DEVICE FOR AUTOMATICALLY DISPENSING TERMINALS FOR ELECTRIC CONDUCTING CABLES

BACKGROUND OF THE INVENTION

1. Field of the Invention

The present invention relates to an automatic dispenser for connection terminals usable in a machine for automatically fitting these terminals to the bared ends of electric conducting cables.

As is known, this type of terminal is frequently used for facilitating connection to clamping terminals for electric conductors such as multistrand electric cables covered with an insulating sheath.

2. Description of the Prior Art

It is usually formed, for example as described in the patent FR 1 468 859 in the name of the applicant, of a tubular metal element intended to receive the bared end of the conductor and an insulating sleeve which extends the tubular element on one side and in which the end of the insulating sheath is engaged.

Of course, this terminal can be fitted to the bared end of a conducting cable manually using traditional tools (wire stripper, pliers). However, this method, which is too costly in time and staff, is not suitable for high rate industrial wiring productions.

This is why machines have already been proposed for automatically fitting the terminals which include a terminal feed device and a fitting device adapted for receiving the terminals one by one and then engaging them on the bared end of respective conducting cables.

Usually, this fitting device consists of a movable part having a container with an appropriate shape for receiving and holding the terminal in a given orientation, and moving between a station for dispensing the terminals coming from the feed device and a station where the terminal is fitted on the conductor.

It is clear that the dispensing station must necessarily include a dispenser adapted for introducing the terminals one by one suitably into said container.

SUMMARY OF THE INVENTION

The invention provides a dispenser of this kind which has as simple a structure as possible and nevertheless provides great reliability.

It provides generally a dispenser adapted for inserting terminals one by one into a receptacle provided in a reception part, for example, of an automatic terminal fitting machine, this dispenser comprising more particularly:

a body, at least partially tubular, adapted for containing a plurality of terminals disposed end to end, this body having at one of its ends a dispensing orifice towards which the terminals are fed;

means for causing a relative movement of said body and of the reception part so as to bring them into a position of cooperation in which said dispensing orifice is in line with an at a small distance from said receptacle;

at least one closure member mounted on said body and urged by resilient means for closing said orifice at least partially and thus retaining the terminals contained in said body, in the absence of an external force, stop means secured to the reception part and aedapted so as to come to bear on an abutment surface of the closure member and to move this latter against the action of the resilient means for releasing the dispensing orifice when the reception part and the body reach said position of cooperation, such release causing the transfer of a terminal contained in the body into the receptacle of the reception part.

According to another feature of the invention, said closure member may advantageously consist of a resilient gripper formed by a cylindrical sleeve with an inner diameter substantially equal to the outer diameter of said body, this sleeve being extended axially by at least two flexible tongues having, at their ends opposite said sleeve, two respective jaws which project radially one towards the other, defining therebetween a space of a width less than the outer diameter of the insulating sleeve of the terminal, these two jaws having two end surfaces symmetrical with respect to the axis of the sleeve and converging inwardly of the closure member.

This resilient gripper is fitted to the body by engaging this latter in the sleeve until the dispensing orifice comes immediately adjacent the jaws.

Furthermore, the end surfaces of the two jaws are provided for cooperating with corresponding abutment surfaces on a flange of the reception part which projects axially around the container.

Thus, in the position of cooperation, the action of said abutment surfaces on said end surfaces by a wedge effect causes the jaws to separate with bending of the tongues, such separation freeing the dispensing orifice to let a terminal pass which is then introduced into the container.

Advantagouesly, the closure member is formed from a cylindrical tube made of a resiliently deformable material in which are formed axial slits which define the flexible tongues, which are then in the form of cylindrical sectors.

The jaws may also have an axial section of triangular shape and consequently comprise, in line with the dispensing orifice, a conical surface adapted for cooperating with a conical surface of the terminals situated at the level of the connection between the tubular metal element and the insulating sleeve.

In this case, the end surfaces of the jaws also have a conical shape adapted for cooperating with a cooresponding conical shape of said flange.

BRIEF DESCRIPTION OF THE DRAWINGS

One embodiment of the invention will be described hereafter by way of non limitative example with reference to the accompanying drawings in which.

Figures 1, 2, 3, 4, 5, 6, 7:
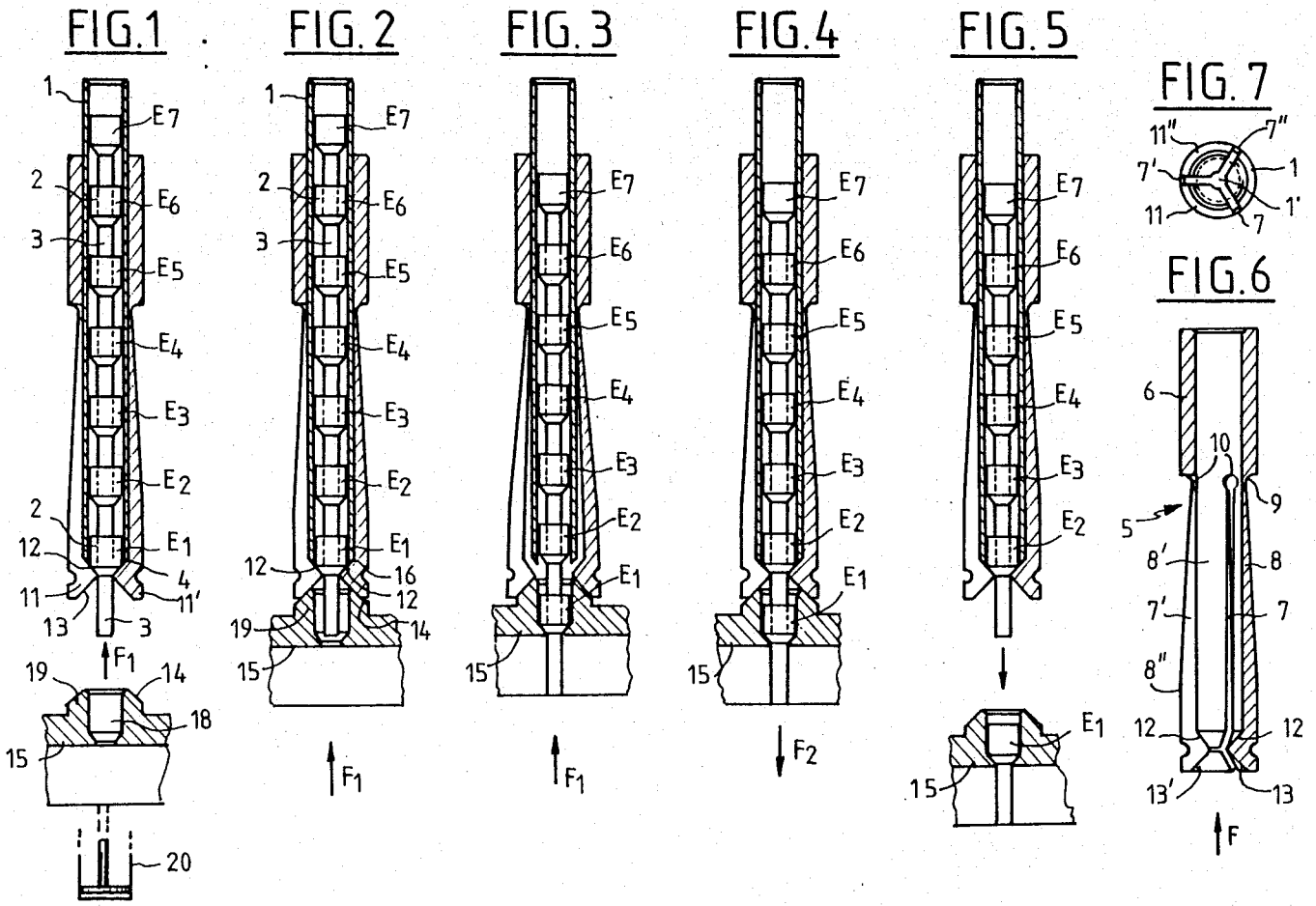
FIGS. 1 to 5 are axial sections of a dispenser and of the reception member which is associated therewith, during their different operating phases, namely.
Figure 8:
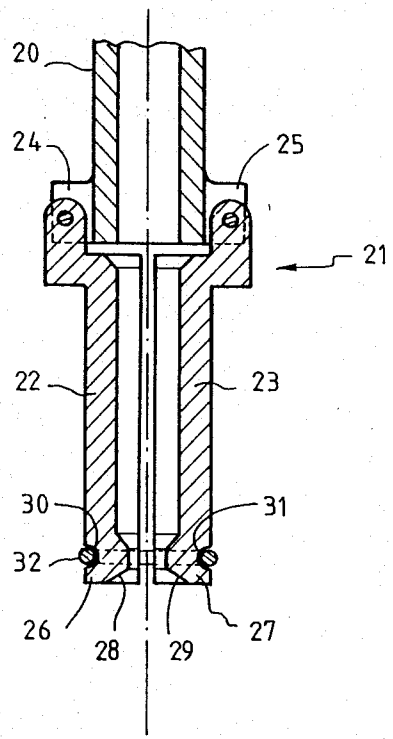

an initial phase (FIG. 1);

a first transient phase (FIG. 2);

a dispensing phase (FIG. 3);

a second transient phase (FIG. 4);

a final phase (FIG. 5);

FIG. 6 is an axial sectional view of the resilient gripper used in the dispenser shown in FIGS. 1 to 5;

FIG. 7 is an axial view along arrow F of the jaws of the resilient gripper shown in FIG. 6; and FIG. 8 is an axial section of another embodiment of the device of the invention.

MORE DETAILED DESCRIPTION OF THE INVENTION

Such as shown in these FIGS., the dispenser includes a cylindrical tubular body 1 whose inner diameter is substantially equal to the outer diameter of the insulating sleeve 2 of the terminals. In this example, the cylindrical body 1 is vertical and contains a plurality of terminals $E_1$ to $E_7$ disposed end to end. The tubular metal elements 3 of these terminals are then oriented downwardly and penetrate into the respectively adjacent insulating sleeves 2.

The lower orifice 4 of the body towards which the terminals $E_1$ to $E_7$ are fed under their own weight forms the dispensing orifice. A resilient gripper 5, formed of a cylindrical tubular section of an inner diameter substantially equal to the outer diameter of said body 1 (FIG. 6), is mounted coaxially on body 1.

This cylindrical section forms, in its upper part, a cylindrical sleeve 6 for fixing the resilient gripper 5 on body 1. In its lower part it has three axial slits 7, 7', 7" disposed at 120° which define three flexible tongues 8, 8', 8".

The resilience of these tongues is increased by a reduction of their thickness from their lower end as far as their connection 9 with section 6, and by a slight reduction of their width (holes 10) at the level of this connection 9 so as to obtain a resilient hinge effect.

The ends of tongues 8, 8', 8" are provided with jaws 11, 11', 11" which extend radially towards the central axis of the resilient gripper, these jaws having a substantially triangular axial section and, consequently, two coaxial connical surfaces one, 12, of which is oriented towards the inside of the gripper and the other, 13, oriented towards the outside, forms an abutment surface provided for cooperating with a corresponding abutment surface 14 provided on the reception part 15, as will be explained further on in the description.

As can be seen in the FIGS., body 1 is engaged in gripper 5 until its end 16, which defines the dispensing orifice 4, abuts against the base of the conical surfaces 12 of jaws 11, 11', 11".

Thus, in the absence of an external force on the gripper, the dispensing orifice 4 is partially closed by jaws 11, 11', 11" and terminals $E_1$ and $E_7$ are then retained in the body.

Advantageously the jaws 11, 11', 11" are dimensioned so as to leave a circular orifice 17 through which the tubular metal element 3 of the last terminal $E_1$ of the stack may pass, the conical surfaces 12 then only acting on the external surface of the insulating sleeve 2 situated at the level of its junction with the tubular element 3 and which usually has a conical shape.

As mentioned above, the dispenser of the invention also has a reception part 15 with a container 18 which has a shape at least partially complementary to that of terminals $E_1$ to $E_7$.

This reception part 15 further has, about the container, an axially projecting flange 19 which has a conical abutment surface 14 substantially complementary to the conical surfaces 13 of the jaws.

In this example, the reception part 15 which may possibly form part of a machine for automatically fitting terminals, may be moved, for example, by means of an actuator shown schematically by a cylinder 20, between two positions in which container 18 is oriented coaxially to body 1, namely:

a first position in which it is moved away from the jaws 11, 11', 11" of the resilient gripper 5 (FIG. 1); and a second position in which the conical surface 14 of flange 19 cooperates with the external conical surfaces 13 of jaws 11, 11', 11", for moving these latter away and for freeing the dispensing orifice 4 in body 1, by causing tongues 8, 8', 8" to bend and/or to pivot about their resilient hinges (connections 9).

The operation of the above described dispenser is the following:

In a first phase (FIG. 1) the reception part 15 is in its first position with receptacle 18 empty, under the effect of cylinder 20, the reception part 15 is moved in translation towards body 1 (arrow $F_1$) until, in an intermediate position, the conical surface 14 of flange 19 abuts against the conical surfaces 13 of jaws 11, 11', 11" (FIG. 2). There then occurs a self centering effect of reception part 15 with respect to body 1 as well as partial engagement of the tubular element 3 of terminal $E_1$ which projects from jaws 11, 11', 11", inside the receptacle 18.

The further movement of the reception part 15 towards body 1 then causes jaws 11, 11', 11" to open until this part 15 reaches its second position (FIG. 3).

In this position, the dispensing orifice 4 is completely freed. Terminal $E_1$ falls into the receptacle, thus causing a downward movement of the stack of terminals $E_2$ to $E_7$. The last but one terminal $E_2$ of the initial stack is then retained by terminal $E_1$, so that its insulating sleeve 2 remains in body 1.

During the next phase, the reception part 15 containing terminal $E_1$ is moved in the opposite direction (arrow $F_2$) so as to return to its first position (FIG. 5).

At the beginning of this movement, the jaws 11, 11', 11" which are no longer urged by the conical surface 14 of flange 19, return to their initial position while retaining the insulating sleeve 2 of terminal $E_2$ (FIG. 4).

The reception part 15 may then be moved, for example, so as to fit temrinal $E_1$ on the bared end of a conducting cable, and then to come back empty to its first position, such as shown in FIG. 1.

A new operating cycle may then begin.

Of course, the invention is not limited to the above described embodiment.

Thus, for example, the resilient gripper 5 and body 1 could form one and the same piece, terminal $E_1$ to $E_7$ then being guided in the lower part of the dispenser only by the resilient tongues 8, 8', 8".

Similarly, the device could include, as shown in FIG. 8, a tubular body 20 with, at its lower end 21 an articulated gripper having at least two levers 22, 23 pivoting at one of their ends in respective hinge mounts 24, 25 provided on said body 20. These hinge mounts 24, 25 are adapted so as to limit, on one side, the pivoting movement of levers 22, 23 in a position such that they define therebetween a cylindrical volume extending the inner volume of body 20.

The free ends 26, 27 of these levers 22, 23 are provided with jaws having conical sides 28, 29 oriented towards each other, so as to leave in said position only a cylindrical passage letting only one tubular metal element of a terminal pass. Furthermore, levers 22, 23 have, at the level of their external surface opposite jaws 28, 29 respective grooves 30, 31 for receiving a toric spring 32 tending to maintain the levers in said position.

It is clear that the operating principle of this device is similar to that of the above described devices. In fact, in a similar way, the conical surface 14 of flange 19, by coming to bear on the conical sides of jaws 28, 29, will cause the levers 22, 23 to open against the action of the spring 32.

What is claimed is:

1. A terminal dispensing device for automatically dispensing, one by one connection terminals for electric conducting cables each having a conductor covered by an insulating sheath and a bared end, said terminals each having a tubular metal element intended to receive the bared end of the cable, and an insulating sleeve which extends the tubular element on one side thereof and which delimits an inner volume wherein the insulating sheath as well as a tubular element of an adjacent terminal may be engaged, which device comprises:

i. a body at least partially tubular-shaped, so as to contain at least first and second terminals disposed end to end, with the tubular element of the second terminal being engaged into the sleeve of the first terminal, said body having an end provided with a dispensing orifice, ii. a reception part provided with a hollow receptacle having the shape at least partially complementary to that of the terminal, iii. means for causing a relative movement of the said body and of the reception part, so as to bring the body into a position of cooperation in which the dispensing orifice is in line with and at a small distance from said hollow receptacle, iv. at least one closure member comprising a resilient gripper formed by cylindrical sleeve engaging on said body and which is extended axially by at least two flexible tongues having, opposite said sleeve, an end provided with at least two respective jaws which project radially one towards the other so as to close the dispensing orifice at least partially in a rest position wherein no external action is exerted on said tongues, each of said jaws having an end provided with two successive slanted surfaces forming an angular narrowing, namely an end surface which converges towards the inside of the closure member and an internal surface which converges towards the outside of the closure member, v. an abutment surface provided on a flange of the reception part which projects axially around the receptacle, said abutment surface bearing on the end surface and causing a flexure of the tongues for releasing the dispensing orifice when the reception part and the body reach said position of cooperation, so as to cause the transfer of the first terminal into the receptacle, said distance being determined so that the first terminal, once lodged in the receptacle, maintains the second terminal partially engaged in the body so as to be retained by the jaws when subsequently the body is spaced from the reception part and hence the closure member returns into its rest position.

2. A terminal dispensing device for automatically dispensing, one by one connection terminals for electric conducting cables each having a conductor covered by an insulating sheath and a bared end, said terminals each having a tubular metal element intended to receive the bared end of the cable, and an insulating sleeve which extends the tubular element on one side thereof and which delimits an inner volume wherein the insulating sheath as well as a tubular element of an adjacent terminal may be engaged, which device comprises:

i. a body at least partially tubular-shaped so as to contain at least first and second terminals disposed end to end, with the tutular element of the second terminal being engaged into the sleeve of the first terminal, said body having an end provided with a dispensing orifice, ii. a reception part provided with a hollow receptacle having a shape at least partially complementary to that of the terminal, iii. means for causing a relative movement of the body and of the reception part so as to bring the body into a position of cooperation in which the dispensing orifice is in line with said hollow receptacle, iv. at least one closure member comprising a resilient gripper mounted at the lower end of said body and comprising at least two levers which are each articulated on said body, said levers having an end provided with at least two respective jaws which project radially one towards the other so as to close the dispensing orifice at least partially in a rest position wherein no external action is exerted on said levers, each of said jaws having an end provided with two successive slanted surfaces forming an angular norrowing, namely an end surface which converges towards the inside of the closure member and an internal surface which converges towards the outside of the closure member, v. an abutment surface provided on a flange of the reception part which projects axially around the receptacle, said abutment surface bearing on the end surface and causing tilting movement of the levers for releasing the dispensing orifice when the reception part and the body reach said position of cooperation, so as to cause the transfer of the first terminal into the receptacle, said first terminal, once lodged in the receptacle, maintaining the second terminal partially engaged in the body, so as to be retained by the jaws when subsequently the body is spaced from the reception part and hence the closure member returns into its rest position.

3. Device as claimed in claim 1, wherein, in the rest position, said jaws define therebetween a space of a width less than the outer diameter of the insulating sleeve of the terminals, but greater than the diameter of the tubular metal element of said terminals.

4. Device as claimed in claim 1, wherein said closure member consists of a cylindrical tube made of a resiliently deformable material in which are forme axial slits which define said flexible tongues.

5. Device as claimed in claim 4, further comprising three axial slits spaced at 120° from each other which define three flexible tongues.

6. Device as claimed in claim 1, wherein said end surface has a conical shape which cooperates with a corresponding conical shape of said flange.

7. Device as claimed in claim 2, wherein said levers have free ends which are provided with jaws whose centripetal application is ensured by means of a toric spring.

* * * * *